United States Patent [19]

Poellmann

[11] 4,303,260

[45] Dec. 1, 1981

[54] SAFETY SKI BINDING

[75] Inventor: Edgar Poellmann, Vienna, Austria

[73] Assignee: TMC Corporation, Baar, Switzerland

[21] Appl. No.: 39,887

[22] Filed: May 17, 1979

[30] Foreign Application Priority Data

May 19, 1978 [AT] Austria ..... 3666/78

[51] Int. Cl.[3] ..... A63C 9/00

[52] U.S. Cl. ..... 280/625; 280/623

[58] Field of Search ..... 280/625, 624, 626, 627, 280/628, 629, 630, 631, 632, 634, 611, 623, 613, 636, 162; 16/91; 114/220; 293/125, 49

[56] References Cited

U.S. PATENT DOCUMENTS

| | | | |
|---|---|---|---|
| 2,745,672 | 5/1956 | Meier, Jr. | 280/627 |
| 3,095,209 | 6/1963 | Covini | 280/626 |
| 3,189,362 | 6/1965 | Weberling | 280/627 |
| 3,207,525 | 9/1965 | Hvam | 280/630 |
| 3,306,053 | 2/1967 | Fulton | 114/220 X |
| 3,902,730 | 9/1975 | Tschida et al. | 280/625 |

FOREIGN PATENT DOCUMENTS

| | | | |
|---|---|---|---|
| 268110 | 1/1969 | Austria | 280/625 |

*Primary Examiner*—Joseph F. Peters, Jr.
*Assistant Examiner*—Milton L. Smith
*Attorney, Agent, or Firm*—Blanchard, Flynn, Thiel, Boutell & Tanis

[57] ABSTRACT

A roller construction for use on the lever arms of a front jaw of a ski binding. The rollers have a central opening therethrough which has a radially enlarging characteristic from the midlength portion thereof toward the axial end thereof. That is, the diameter of the opening adjacent the axial ends is greater than the diameter of the opening at the midlength portion thereof. The interior surface of the opening at the midlength portion thereof is rounded at a radius which is substantially greater than the diameter of the roller. The interior diameter of the roller at the midlength portion is generally equal to or preferably slightly larger than the diameter of the axle received in the opening. The contour of the wall of the opening facilitates a rocking or tilting of the roller relative to the axis of the axle. As a result, the roller can assume a tilted position relative to the axis of the axle as the ski boot sole shifts its position relative to the ski binding. Thus, the release of the ski boot from the ski binding is not hindered in any way.

9 Claims, 4 Drawing Figures

SAFETY SKI BINDING

FIELD OF THE INVENTION

The invention relates to a safety ski binding comprising a roller supported on at least one, preferably each of two axles which are arranged on both sides of a swivel jaw in the position of use spaced from the boot sole and which are substantially prependicular with respect to the base plate of the binding, on which roller or rollers the ski boot is supported preferably only during a safety release.

BACKGROUND OF THE INVENTION

A safety ski binding of this type is described generally in Austrian Patent No. 268 110. However, this known solution provides a support of the boot sole only during a safety release.

In a different known construction according to Austrian Patent No. 321 170 (see also U.S. Pat. No. 3,902,730), the tip of the ski boot sole is constantly supported in the clamped-in position of the ski boot on two rollers which are symmetrically arranged laterally with respect to the central longitudinal axis of the ski, wherein each of the lever arms has a still further roller, so that during a lateral safety release the ski boot sole moves always along a path which is formed by two rollers, namely an inner and an outer roller.

The above-listed and further known solutions have the disadvantage that the ski boot sole can be supported only along a line or (narrow) strip which extends in longitudinal direction of the individual rollers, when the axis of the individual rollers extends parallel with respect to the support area of the ski boot sole. Not only small inexactnesses in the vertical arrangement of the roller axes, but, and primarily the deformation of the ski boot sole can cause a support to occur through the formation of an acute angle between the ski boot and the roller.

In the case of a safety ski binding according to U.S. Pat. No. 3,095,209, which, however, belongs to a different class than the present binding, it is already known to use a pair of rollers, which is arranged rotatably about an axis which lies in the horizontal plane, for holding down the heel of the ski boot. For a better support of the ski boot heel, the pair of rollers is constructed utilizing two truncated balls, which together form an hourglasslike structure, wherein a bearing point for the axis of the rollers is arranged between the two truncated ball-shaped rollers. Since this known solution can be utilized effectively and with success only in the horizontal plane, it is not suited for the solution of a problem for the support of a ski boot sole in longitudinal direction of the ski.

To support a ski boot heel, it has also already been suggested according to U.S. Pat. No. 2,745,672 to provide the heel with an extension, the side of which remote from the ski boot is sloped and is loaded by a roller which is supported around an axis which is positioned also sloped with respect to the upper surface of the ski. Even if here too a balancing adjustment between the roller and the support element appears as being possible, then the arrangement between the support surface and the axis of the roller is substantially correspondingly parallel as in the solution according to the already considered state of the art. Therefore, a compensating of inexactnesses requires also in the case of this solution a special measure. The known arrangement is moreover more complicated than the already considered solution according to Austrian Patent No. 268 110.

A roller with a toothed outer side is already known for example from Austrain Patent No. 268 952.

Therefore, the purpose of the invention is to design a safety ski binding of the type mentioned above such that it does not have the listed disadvantages and in which resulting of the ski boot sole on the roller—in every clamped-in position of the ski boot—occurs as much as possible along the entire extent of a line.

The set purpose is inventively attained by each roller being pivotally supported through a limited range with respect to the associated axis, adjusting to the respectively created pressure of the sole, about said axis. In this manner, a secure resting on the support roller or on the support rollers is assured in each position of the ski boot and also independently of the wear on the ski boot sole. Furthermore, it is assured that the clamping force which acts in longitudinal direction of the ski is fully utilized.

A particularly preferable embodiment of the invention consists in the magnitude of swiveling of each roller being determined by an opening, which consists of two openings which are tapered inwardly from the two free ends of the roller, wherein the two openings—viewed in the longitudinal extent of the roller—transfer into one another approximately at the mid-length part of the roller. This measure assures in the initial position a central support for the individual rollers, wherein differences in the clamping of the ski boot or wear on the ski boot sole and/or on the roller in both directions—by swiveling the individual rollers in or out—can be compensated. If several, for example two rollers are provided, it is possible to balance out the differences by swinging one roller out—and the other one at the same time in, or vice versa.

In a further development of this thought of the invention, it is provided that the transition between the two openings is formed by a flat rounded-off portion, formed on a radius which is large in relationship to the dimensions of the roller, preferably approximately 4 to 8 times the roller radius. This permits a particularly good centering of the individual rollers, without accepting limitations in the action of the balancing of the differences.

BRIEF DESCRIPTION OF THE DRAWINGS

Further advantages, details and characteristics of the invention will be described more in detail with reference to the drawings, which illustrate one exemplary embodiment.

In the drawings.

DETAILED DESCRIPTION

Figure 1:
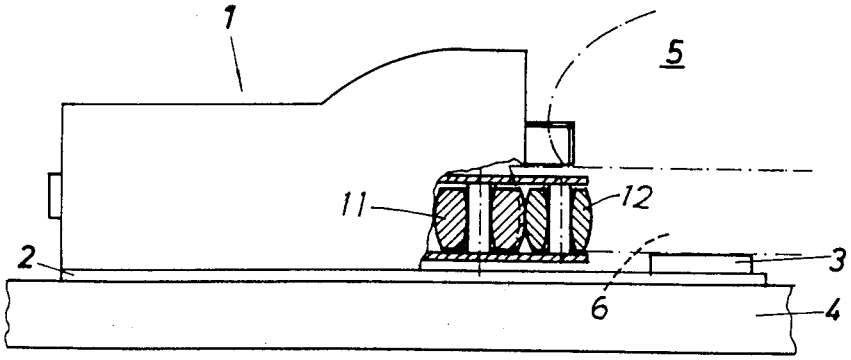
FIGS. 1 and 2 are a side view and a cross-sectional view of the arrangement of an inventive safety ski binding.
Figure 2:
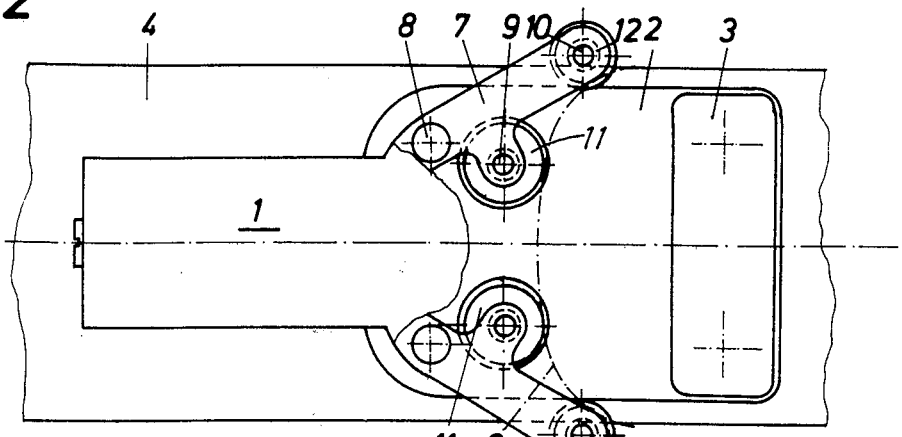

The safety ski binding which is illustrated in FIGS. 1 and 2 is a front jaw which is identified as a whole by the reference numeral 1, and which by an interpositioning of a base plate 2 and a support plate 3 is secured to the upper surface of a ski 4, for example in a conventional manner by screws. The sole 6 of a ski boot 5, only the toe of which is indicated in broken lines in FIGS. 1 and 2, is supported by the front jaw 1. The front jaw has for this support conventional lever arms 7 which are pivotally supported on axles 8, which axles extend perpendicularly with respect to the upper surface of the ski and can be pivoted outwardly in a conventional manner against a spring force. Such constructions are known and, therefore, do not need to be discussed any further.

Each lever arm 7 has on its side which faces the ski boot sole 6 two axles 9 and 10, on each of which is rotatably supported one roller 11 and 12, respectively. Each of the two rollers 11 which are positioned closer to the central longitudinal axis of the ski serves to support the tip or forward end of the ski boot sole 6 and the two other rollers 12 which are positioned adjacent the two lateral edges of the ski serve to support the lateral sides of the ski boot sole 6.

Figure 3:
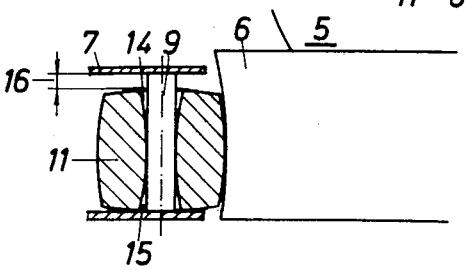
FIG. 3 illustrates a detail of FIG. 1 in an enlarged scale.
Figure 4:
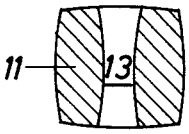
FIG. 4 illustrates a roller according to FIG. 3.

The structure of the individual rollers can better be recognized from FIG. 3. The roller 11 illustrated in FIG. 4 has an opening 13 therethrough, which opening, as can better be recognized from FIG. 3, consists of two axially inwardly converging or conical-like openings 14 and 15. The two openings 14, 15 meet approximately at the midlength part of the roller 11. The transition between the small diameter ends of the two openings 14, 15 is designed in form of a flat rounded-off portion, the radius of which is relatively large in relationship to the dimensions of the roller, approximately 4 to 8 times the roller diameter.

The outer periphery of each roller has a rounded contour, the radius of which is generally 25 to 75 mm (1–3 inches). A corresponding surface contour is provided on the front edge portion of the sole 6. The radius of the surface contour on the ski boot is the same or greater than the radius of the contoured surface on the roller. This means that the contact surface between the roller and the corresponding surface of the ski boot increases and so the contact pressure of the roller on the corresponding surface of the ski boot decreases.

The operation of the inventive construction is simple. It is only necessary for the ski boot sole 6 to be positioned at an angle to one of the axles 9, 10, after which the associated roller 11 or 12 moves into the desired sloped position with respect to the axis which is associated with said roller. The arrangement is such that a swinging of the upper region of the individual rollers 11 and 12 can occur both inwardly and outwardly, wherein the lower regions of the rollers move simultaneously inwardly or outwardly, as the case may be. By providing a gap 16 between the upper axial end surface of the roller 11 and the underside of the lever arm 7, the space needed for the sloped condition is provided, so that the individual rollers 11 and 12 are not jammed by the pivoting action about their respective axes. The individual rollers 11 or 12 can therefore roll along unhindered, so that the release operation of the ski boot from the ski binding is not hindered in any way.

The possibly occurring friction between the lower axial end surface and/or the upper axial end surface of the individual rollers 11, 12 and the inner surfaces of the lower or upper part of the individual lever arms 7 of the front jaw 1 can be inventively avoided by also rounding off these areas (the supporting surfaces) of the individual rollers 11, 12 with a suitable radius. The size of the radius which determines the degree of the rounded-off portions corresponds with the friction-free pivoting of the roller which is to be performed about the associated axis 9 or 10, so that the lower and/or upper axial end surfaces of individual rollers 11, 12 will swing or roll along on or at the support surfaces on the associated lever arm part.

The invention is not limited to the illustrated exemplary embodiment. Further modifications are possible without departing from the scope of the invention. For example, one single roller which supports the ski boot tip can be provided or it is also possible to arrange three rollers, of which one is centrally supported with respect to the longitudinal axis of the ski. Individual or all rollers can also have grooves therein which extend in longitudinal direction of the roller, through which a better adhesion with the ski boot is achieved in the clamped-in position thereof.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding having a base plate adapted to be mounted on a ski and at least one lever arm pivotally secured to said base plate and for movement with respect thereto about an upright first axis between a ski boot holding position and a ski boot releasing position, the improvement comprising at least one roller member rotatably mounted on said lever arm and about an upright axle having a second axis, said roller being positioned to engage said ski boot at least when said lever arm is in any position between said ski boot holding position and said ski boot releasing position, including said ski boot releasing position, said roller having a central opening therethrough, the interior wall of said central opening converging from the axial ends of said roller toward a location intermediate said axial ends, the diameter of said central opening adjacent said axial ends being greater than at said intermediate location, the diameter of said central opening at said intermediate location being equal to or slightly greater than the diameter of said axle whereby the axis of said roller is able to adjust to an inclined relation to said second axis of said axle in response to varying forces applied by said ski boot to the exterior of said roller during a release of said ski boot from said ski binding.

2. The safety ski binding according to claim 1, wherein said interior wall of said central opening at said intermediate location is in the shape of a flat rounded-off portion having a radius which is in the range of 4 to 8 times the radius of said roller.

3. The safety ski binding according to claim 1, wherein said second axis extends substantially perpendicular to the plane of said base plate, wherein said lever arm has a horizontally extending upper flange with a downwardly facing surface, said upright axle being secured at the upper end thereof to said upper flange, wherein between the upper axial end surface of each roller and said downwardly facing surface of said lever arm, on which said roller is arranged, there is provided a gap, which assures said roller a jamfree rotation capability in an adjusted position thereof with said axis of said roller inclined to said second axis.

4. The safety ski binding according to claim 3, wherein said lever arm also includes a lower flange having an upwardly facing surface thereon, said upright axle being secured to and extending between said upper and lower flanges, wherein at least the lower axial end surface of said roller is rounded off, wherein said rounded-off facilitates a frictionfree adjusting of said roller relative to said lever arm.

5. The safety ski binding according to claim 4, wherein the upper axial end surface is also rounded-off.

6. The safety ski binding according to claim 1, wherein said intermediate location is positioned midway between the axial end surfaces of said roller.

7. The safety ski binding according to one of claims 1, 2 to 4 or 6, wherein a pair of said lever arms are mounted on said base plate and on opposite lateral sides of a longitudinal center line of said base plate, each of said lever arms having at least one of said rollers thereon.

8. The safety ski binding according to claim 7, wherein a pair of said rollers are mounted on each of said lever arms.

9. The safety ski binding according to claim 1, wherein the exterior surface of said roller has a rounded contour.

* * * * *

UNITED STATES PATENT AND TRADEMARK OFFICE

CERTIFICATE OF CORRECTION

PATENT NO. : 4 303 260

DATED : December 1, 1981

INVENTOR(S) : Edgar Poellmann

It is certified that error appears in the above—identified patent and that said Letters Patent is hereby corrected as shown below:

Column 5, line 2; before "facilitates" insert ---portion---.

Signed and Sealed this

Sixteenth Day of March 1982

[SEAL]

*Attest:*

GERALD J. MOSSINGHOFF

*Attesting Officer*

*Commissioner of Patents and Trademarks*